US006843118B2

(12) United States Patent
Weintraub et al.

(10) Patent No.: US 6,843,118 B2
(45) Date of Patent: Jan. 18, 2005

(54) FORMATION TESTER PRETEST USING PULSED FLOW RATE CONTROL

(75) Inventors: Preston N. Weintraub, The Woodlands, TX (US); Pedro R. Segura, Houston, TX (US); Mark A. Proett, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 151 days.

(21) Appl. No.: 10/094,544

(22) Filed: Mar. 8, 2002

(65) Prior Publication Data

US 2003/0167834 A1 Sep. 11, 2003

(51) Int. Cl.[7] ..... E21B 49/00
(52) U.S. Cl. ..... 73/152.05; 73/152.41
(58) Field of Search ..... 73/152.02, 152.05, 73/152.17, 152.24, 152.26, 152.41, 152.51; 166/264, 386

(56) References Cited

U.S. PATENT DOCUMENTS

| | | | | | |
|---|---|---|---|---|---|
| 3,859,851 | A | * | 1/1975 | Urbanosky | 73/152.24 |
| 4,513,612 | A | * | 4/1985 | Shalek | 73/152.24 |
| 4,593,560 | A | | 6/1986 | Purfurst | 73/155 |
| 4,745,802 | A | | 5/1988 | Purfurst | 73/155 |
| 4,843,878 | A | | 7/1989 | Purfurst et al. | 73/155 |
| 4,845,982 | A | | 7/1989 | Gilbert | 73/151 |
| 4,860,581 | A | * | 8/1989 | Zimmerman et al. | 73/152.26 |
| 4,879,900 | A | | 11/1989 | Gilbert | 73/155 |
| 4,884,439 | A | | 12/1989 | Baird | 73/155 |
| 4,936,139 | A | * | 6/1990 | Zimmerman et al. | 73/152.26 |
| 5,101,907 | A | | 4/1992 | Schultz et al. | 166/386 |
| 5,184,508 | A | | 2/1993 | Desbrandes | |
| 5,230,244 | A | | 7/1993 | Gilbert | 73/155 |
| 5,231,874 | A | | 8/1993 | Gilbert | 73/151 |
| 5,233,866 | A | * | 8/1993 | Desbrandes | 73/152.05 |
| 5,238,070 | A | | 8/1993 | Schultz et al. | 166/386 |
| 5,329,811 | A | | 7/1994 | Schultz et al. | 73/155 |
| 5,602,334 | A | | 2/1997 | Proett et al. | 73/152.05 |
| 5,622,223 | A | | 4/1997 | Vasquez | 166/264 |
| 5,644,076 | A | | 7/1997 | Proett et al. | 73/152.41 |
| 5,703,286 | A | | 12/1997 | Proett et al. | 73/152.05 |
| 5,934,374 | A | | 8/1999 | Hrametz et al. | 166/264 |
| 6,058,773 | A | | 5/2000 | Zimmerman et al. | 73/152.24 |
| 6,467,544 | B1 | * | 10/2002 | Brown et al. | 166/264 |
| 2002/0084072 | A1 | * | 7/2002 | Bolze et al. | 166/264 |
| 2002/0129936 | A1 | * | 9/2002 | Cernosek | 166/264 |
| 2003/0042021 | A1 | * | 3/2003 | Bolze et al. | 166/264 |
| 2003/0062472 | A1 | * | 4/2003 | Mullins et al. | 250/269.1 |
| 2003/0066646 | A1 | * | 4/2003 | Shammai et al. | 166/264 |

FOREIGN PATENT DOCUMENTS

| | | | |
|---|---|---|---|
| EP | 0697501 A2 | 2/1996 | E21B/49/00 |
| EP | 0 698 722 A2 | 2/1996 | |
| EP | 0697501 A3 | 7/1997 | E21B/49/00 |

* cited by examiner

*Primary Examiner*—Hezron Williams
*Assistant Examiner*—John Fitzgerald
(74) *Attorney, Agent, or Firm*—Conley Rose, P.C.

(57) ABSTRACT

The present invention is directed to methods and apparatus for using a formation tester to perform a pretest, in a formation having low permeability, by intermittently collecting a portion of fluid at a constant drawdown rate. The drawdown pressure is monitored until a maximum differential pressure is reached between the formation and the tester. Then the piston is stopped until the differential pressure increases to a set value, at which time the piston is restarted. The controlled intermittent operation of the piston continues until a set pretest volume is reached. The modulated drawdown allows for an accurate collection of pressure versus time data that is then used to calculate the formation pressure and permeability. The present invention also finds applicability in logging-while-drilling and measurement-while drilling applications where power conservation is critical.

22 Claims, 5 Drawing Sheets

PRIOR ART

FORMATION TESTER PRETEST USING PULSED FLOW RATE CONTROL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to methods and apparatus for using a formation tester to perform a pretest on a subterranean formation through a wellbore to acquire pressure versus time response data in order to calculate formation pressure and permeability. More particularly, the present invention relates to improved methods and apparatus for performing the drawdown cycle of a pretest in a formation having low permeability.

Due to the high costs associated with drilling and producing hydrocarbon wells, optimizing the performance of wells has become very important. The acquisition of accurate data from the wellbore is critical to the optimization of the completion, production and/or rework of hydrocarbon wells. This wellbore data can be used to determine the location and quality of hydrocarbon reserves, whether the reserves can be produced through the wellbore, and for well control during drilling operations.

Well logging is a means of gathering data from subsurface formations by suspending measuring instruments within a wellbore and raising or lowering the instruments while measurements are made along the length of the wellbore. For example, data may be collected by lowering a measuring instrument into the wellbore using wireline logging, logging-while-drilling (LWD), or measurement-while-drilling (MWD) equipment. In wireline logging operations, the drill string is removed from the wellbore and measurement tools are lowered into the wellbore using a heavy cable that includes wires for providing power and control from the surface. In LWD and MWD operations, the measurement tools are integrated into the drill string and are ordinarily powered by batteries and controlled by either on-board and/or remote control systems. Regardless of the type of logging equipment used, the measurement tools normally acquire data from multiple depths along the length of the well. This data is processed to provide an informational picture, or log, of the formation, which is then used to, among other things, determine the location and quality of hydrocarbon reserves. One such measurement tool used to evaluate subsurface formations is a formation tester.

To understand the mechanics of formation testing, it is important to first understand how hydrocarbons are stored in subterranean formations. Hydrocarbons are not typically located in large underground pools, but are instead found within very small holes, or pore spaces, within certain types of rock. The ability of a rock formation to allow hydrocarbons to move between the pores, and consequently into a wellbore, is known as permeability. The viscosity of the oil is also an important parameter and the permeability divided by the viscosity is termed "mobility" ($k/\mu$). Similarly, the hydrocarbons contained within these formations are usually under pressure and it is important to determine the magnitude of that pressure in order to safely and efficiently produce the well.

During drilling operations, a wellbore is typically filled with a drilling fluid ("mud"), such as water, or a water-based or oil-based mud. The density of the drilling fluid can be increased by adding special solids that are suspended in the mud. Increasing the density of the drilling fluid increases the hydrostatic pressure that helps maintain the integrity of the wellbore and prevents unwanted formation fluids from entering the wellbore. The drilling fluid is continuously circulated during drilling operations. Over time, as some of the liquid portion of the mud flows into the formation, solids in the mud are deposited on the inner wall of the wellbore to form a mudcake.

The mudcake acts as a membrane between the wellbore, which is filled with drilling fluid, and the hydrocarbon formation. The mudcake also limits the migration of drilling fluids from the area of high hydrostatic pressure in the wellbore to the relatively low-pressure formation. Mudcakes typically range from about 0.25 to 0.5 inch thick, and polymeric mudcakes are often about 0.1 inch thick. On the formation side of the mudcake, the pressure gradually decreases to equalize with the pressure of the surrounding formation.

The structure and operation of a generic formation tester are best explained by referring to FIG. 5. In a typical formation testing operation, a formation tester 500 is lowered on a wireline cable 501 to a desired depth within a wellbore 502. The wellbore 502 is filled with mud 504, and the wall of the wellbore 502 is coated with a mudcake 506. Because the inside of the tool is open to the well, hydrostatic pressure inside and outside the tool are equal. Once the formation tester 500 is at the desired depth, a probe 512 is extended to sealingly engage the wall of the wellbore 502 and the tester flow line 519 is isolated from the wellbore 502 by closing equalizer valve 514.

Formation tester 500 includes a flowline 519 in fluid communication with the formation and a pressure sensor 516 that can monitor the pressure of fluid in flowline 519 over time. From this pressure versus time data, the pressure and permeability of the formation can be determined. Techniques for determining the pressure and permeability of the formation from the pressure versus time data are discussed in U.S. Pat. No. 5,703,286, issued to Proett et al., and incorporated herein by reference for all purposes.

The collection of the pressure versus time data is often performed during a pretest sequence that includes a drawdown cycle and a buildup cycle. To draw fluid into the tester 500, the equalizer valve 514 is closed and the formation tester 500 is set in place by extending a pair of feet 508 and an isolation pad 510 to engage the mudcake 506 on the internal wall of the wellbore 502. Isolation pad 510 seals against the mudcake 506 and around hollow probe 512, which places flowline 519 in fluid communication with the formation. This creates a pathway for formation fluids to flow between the formation 522 and the formation tester 500.

The drawdown cycle is commenced by retracting a pretest piston 518 disposed within a pretest chamber 520 that is in fluid communication with flowline 519. The movement of the pretest piston 518 creates a pressure imbalance between flowline 519 and the formation 522, thereby drawing formation fluid into flowline 519 through probe 512. The drawdown cycle ends, and the buildup cycle begins, when the pretest piston 518 has moved through a set pretest volume, typically 10 cc. During the buildup cycle, formation fluid continues to enter tester 500 and the pressure within flowline 519 increases. Formation fluid enters the tester 500 until the fluid pressure within flowline 519 is equal to the formation pressure or until the pressure differential is insufficient to drive additional fluids into the tester. The pressure within flowline 519 is monitored by pressure sensor 516 during both the drawdown and buildup cycles and the pressure response for a given time is recorded. Formation testing methods and tools are further described in U.S. Pat. Nos. 5,602,334 and 5,644,076, which are hereby incorporated herein by reference for all purposes.

Formation testing tools are ordinarily designed to operate at a single, constant drawdown rate, and the drawdown continues until a set volume is reached. The control systems that determine the drawdown rate, by controlling the movement of pretest piston 518, are often designed to run most efficiently at a fixed drawdown rate. In order to simplify the design and operation of the system, traditional formation testing tools, such as 500, are also designed to draw in a set volume of fluid during each drawdown cycle. A typical drawdown rate is 1.0 cc/sec with a pretest volume of 10 cc.

In normal applications, pretest piston 518 retracts to draw formation fluid into the flowline 519 at a rate faster than the rate at which formation fluid can flow out of the formation. This creates an initial pressure drop within flowline 519. Once the pretest piston 518 stops moving, the pressure in flowline 519 gradually increases during the buildup cycle until the pressure within flowline 519 equalizes with the formation pressure. During this process, a number of pressure measurements can be taken. Drawdown pressure, for example, is the pressure detected while pretest piston 518 is retracting. This pressure is at its lowest when pretest piston 518 stops moving. Buildup pressure is the pressure detected while formation fluid pressure builds up in the flowline. FIG. 2 depicts a typical pressure versus time plot 210 for a constant rate drawdown.

Maintaining a constant drawdown rate can limit the tester's effectiveness in testing low permeability zones, e.g. <1.0 md (millidarcies), because the drawdown pressure can be reduced below the bubble point of the formation fluid, which will cause gas to evolve from the fluid. To achieve a useful pressure-versus-time response from the pretest, once this occurs it is necessary to wait until the gas is reabsorbed into the fluid. The reabsorption of gas into the fluid can take a long period of time, often as much as one hour. This time delay is often unacceptable to operators, and therefore may preclude the collection of pressure-versus-time data, and subsequent calculation of formation pressure and permeability, from low permeability formations.

Another problem encountered when using constant drawdown methods in LWD or MWD applications is lack of available power. In contrast to wireline logging tools that draw their power through the wireline from a source at the surface, in LWD or MWD applications, the measurement tools are powered by batteries and therefore have limited available power. The power used by the system can be expressed by multiplying the change in pressure within the flowline ($\Delta p_{Flowline}$) by the drawdown rate ($Q_{Drawdown}$), or:

$$\text{Power}=\Delta p_{Flowline}\times Q_{Drawdown} \qquad \text{Eq.1}$$

Therefore, in a low permeability formation where an increased drawdown pressure is required, the power requirements increase for a given drawdown rate. Thus, a large amount of power may be required during the drawdown process, and it may be impractical to provide this power from batteries in a LWD or MWD application.

In order to fully describe the embodiments of the present invention, as well as to illustrate the benefits and improvements of the methods and apparatus, FIG. 1 provides a graphical representation of the operation of a standard formation testing tool, such as the tool of FIG. 5, operating in a low permeability formation. As previously described, the standard formation testing tool 500 is designed to operate with a drawdown rate of 1.0 cc/sec and a pretest volume of 10 cc. In FIG. 1, the low permeability formation from which the sample is collected has a permeability of 0.1 millidarcies (md) or less, and the formation fluid has a bubble point of approximately 700 psi.

FIG. 1 shows plots of pressure versus time, line 102, and drawdown rate versus time, dashed line 104, when attempting to collect a formation fluid sample from a low permeability formation using a conventional constant drawdown rate, such as 1.0 cc/sec for 10 seconds to collect a 10 cc pretest volume. The minimum drawdown pressure, indicated at 110, can drop as much as 10,000 psi below the formation pressure. As mentioned above, in low porosity formations, this minimum pressure 110 can fall below the bubble point 106 of the formation fluid, causing gas bubbles to evolve within the sample. In order to obtain accurate readings, the buildup portion of the cycle must continue until the gas reabsorbs into solution, as at 112, and then sufficient formation fluid is drawn into the tool such that the pressure stabilizes at 114. The gas evolution and reabsorption period, indicated by the portion of the line indicated at 112, takes an extended period of time and this extended period of time is often unacceptable to logging operators. Thus, it is desirable to complete the drawdown cycle without allowing the drawdown pressure to fall below the bubble point of the fluid.

For all of these reasons, it is desired to provide a tool for measuring pressure and permeability without requiring wireline power and without losing effectiveness in low-permeability formations.

SUMMARY OF THE INVENTION

The present invention is directed to improved methods and apparatus for performing a pretest with a formation testing tool. The methods and apparatus of the present invention avoid cavitation and reduce power requirements by retracting a piston at a relatively high drawdown rate intermittently during collection of a pretest volume. This results in a lower average drawdown rate, which decreases power usage and maintains the formation fluid at a pressure above its bubble point.

One embodiment of the present invention is implemented by using a control system to pause the drawdown operation by intermittently stopping the movement of the pretest piston. This embodiment drawdown is performed at a constant rate while the drawdown pressure is monitored until a maximum differential pressure is reached. Once this maximum differential pressure is reached, the pretest piston is stopped. The buildup pressure is allowed to increase to a set threshold value at which time the pretest piston resumes retraction. Therefore the drawdown occurs at a constant rate applied in a stepwise manner that can be represented as a square wave. The controlled intermittent pulsing of the pretest piston continues until the required pretest volume is has been drawn.

BRIEF DESCRIPTION OF THE DRAWINGS

The nature, objects, and advantages of the present invention will become more apparent to those skilled in the art after consideration of the following detailed description in connection with the accompanying figures wherein.

DETAILED DESCRIPTION OF THE PREFERRED EMBODIMENTS

Figure 1:
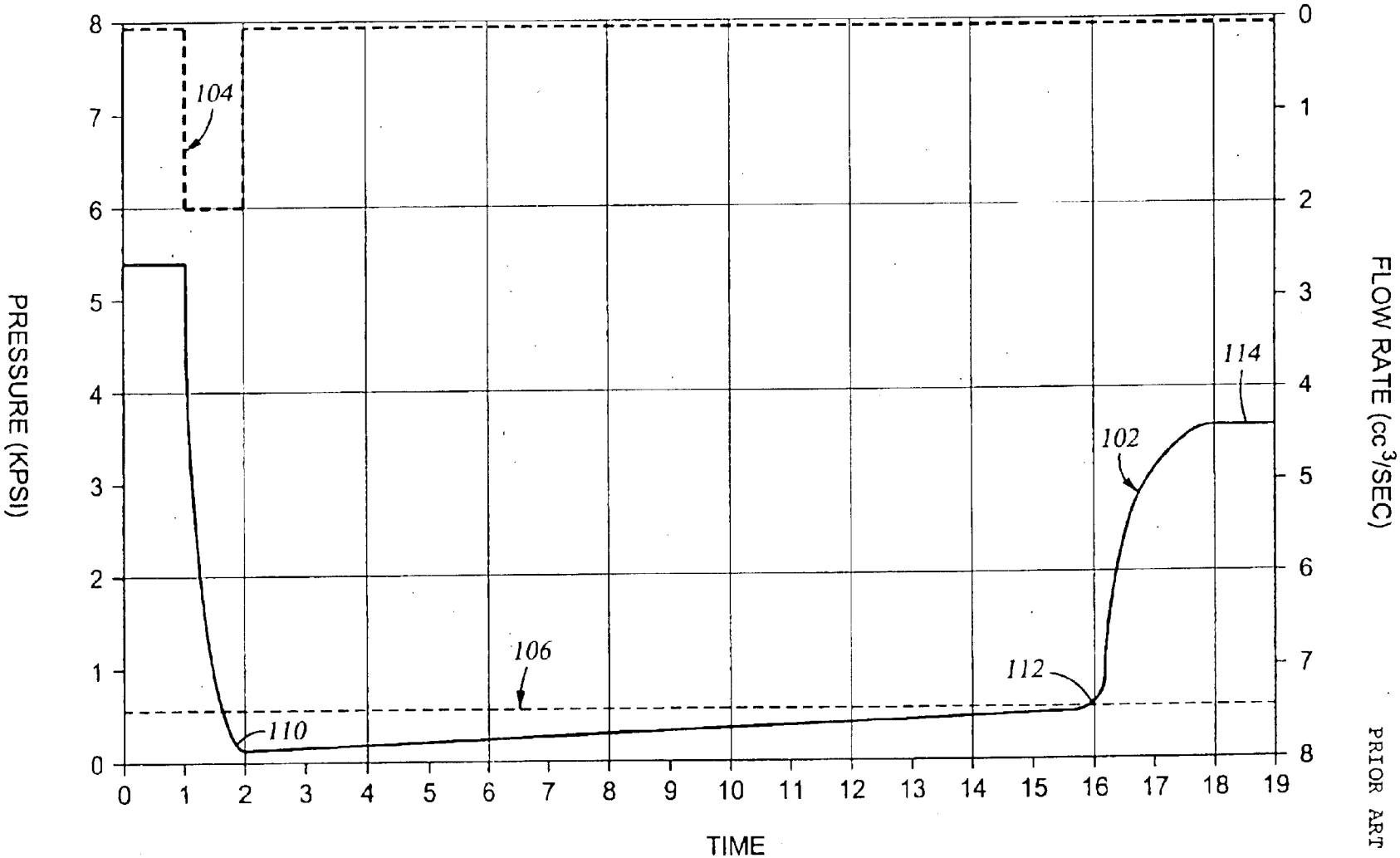
FIG. 1 is a graph illustrating the pressure and associated drawdown rate within a formation tester operated in accordance with prior art methods.
Figure 2:
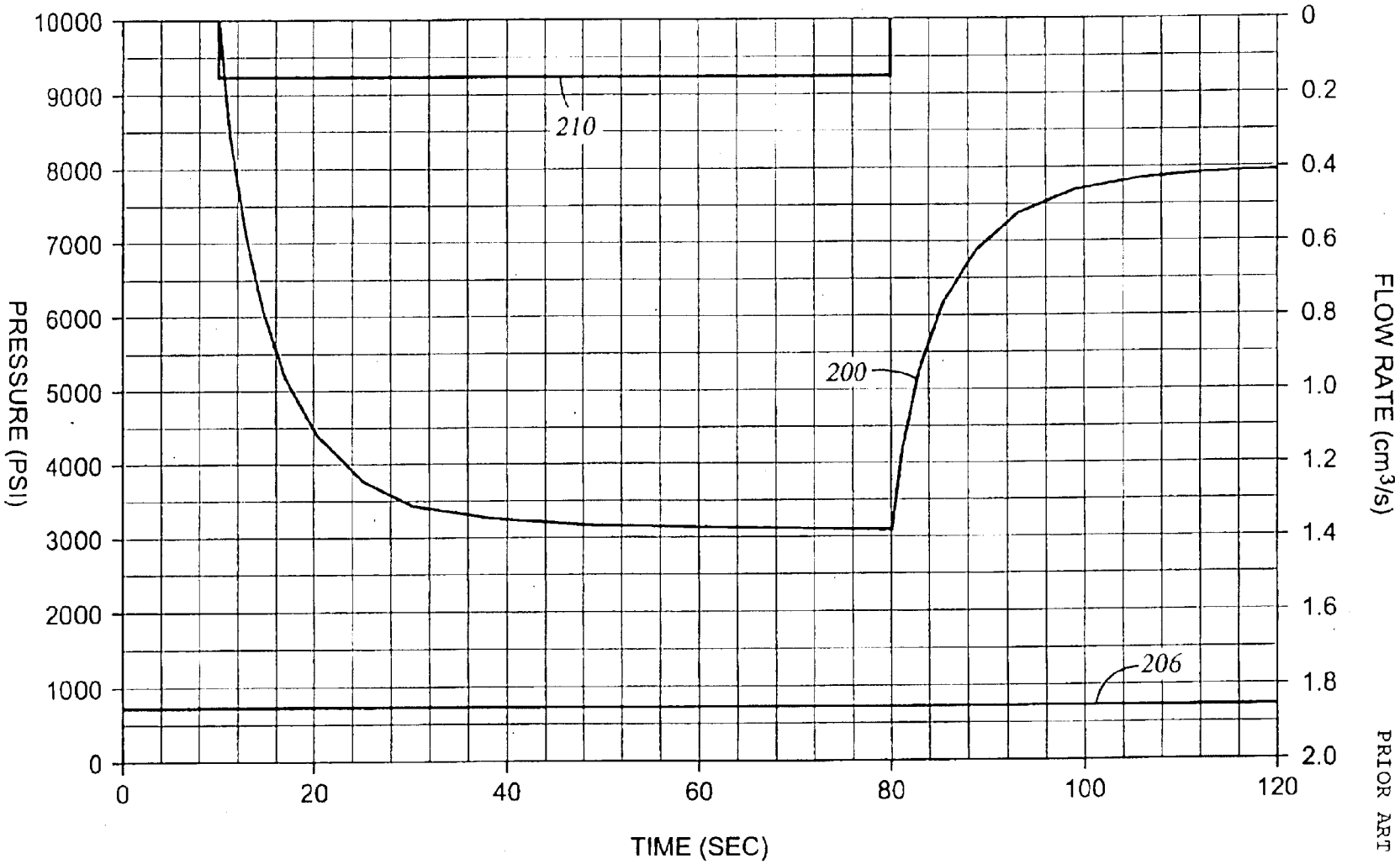
FIG. 2 is a graph illustrating the pressure within a formation tester during formation testing conducted at a low drawdown rate.

FIG. 2 depicts a pressure versus time curve 200 for an alternative drawdown operation in the same 0.1 md formation as described above with respect to FIG. 1. Curve 210 depicts the drawdown rate versus time (using the right vertical scale) for a constant drawdown rate of 0.15 cc/sec. This constant drawdown rate continues for 70 seconds to collect a fluid sample of 10.5 cc. Although the pretest drawdown time of FIG. 2 takes 60 seconds longer than the sample of FIG. 1, the drawdown pressure in FIG. 2 remains above the bubble point 206 of the formation fluid at all times, with the result that gas does not evolve into the flowline. Therefore, one solution to the problem of performing a pretest on a low permeability formation would be to use a pretest piston that operates at a single drawdown rate that is low enough to provide drawdown pressure that stays above the bubble point of the formation fluid. In this case, the rate would not provide a sufficient drawdown to make an effective pretest in higher permeability zones. In addition, as discussed above, the standard tool is designed to operate with a drawdown rate of 1.0 cc/sec. It is not desirable to modify the tool to operate at drawdown rates lower than 1.0 cc/sec.

The preferred embodiments of the present invention achieve the desired results, namely the ability to pretest a low-permeability formation, without having to modify the mechanical portions of a standard testing tool. Put another way, because the present invention allows pretesting of even low-permeability formations without requiring a drawdown system capable of operating at a reduced rate, it allows a single logging tool to be used regardless of formation permeability.

Figure 3:
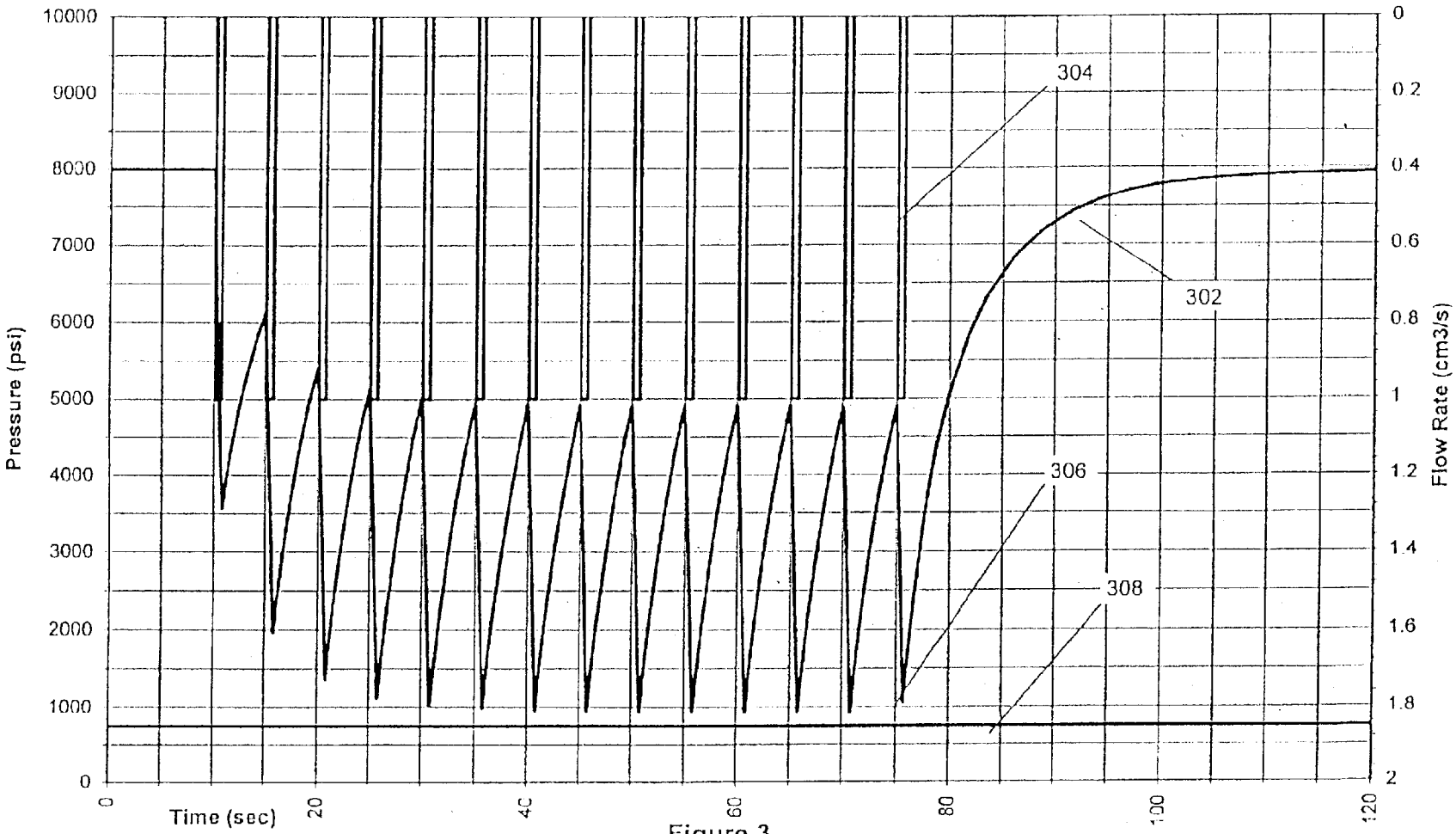
FIG. 3 is a graph illustrating the pressure within a formation tester during formation testing conducted in accordance with one embodiment of the present invention.

Referring now to FIG. 3, one preferred embodiment of the present invention utilizes a conventional drawdown rate of 1.0 cc/sec but modulates that rate so as to achieve a lower effective drawdown rate. Thus, the drawdown occurs at a rate of 1.0 cc/sec but is performed intermittently, instead of continuously, until the desired volume has been drawn. This intermittent drawdown is represented by the flow rate versus time (right vertical scale) versus time curve 304. FIG. 3 also depicts a pressure curve 302 for a drawdown cycle performed using intermittent curve 304. Therefore, it takes 14 pulses, spread over 70 seconds, to fill the desired 10.5 cc pretest volume. Accordingly, the average drawdown rate is equal to the desired 0.15 cc/sec rate of FIG. 2, and is much lower than the 1.0 cc/sec motor could achieve directly. Specifically drawdown is accomplished in 14 pulses of 0.75 second duration and at 5 second intervals. The intermittent drawdown causes low-pressure threshold dips 306 but the minimum pressure never drops below the bubble point 308 of the formation fluid. Therefore, useful pressure-versus-time data can be collected relatively quickly, and can then be used to accurately determine the formation pressure and permeability.

Figure 4:
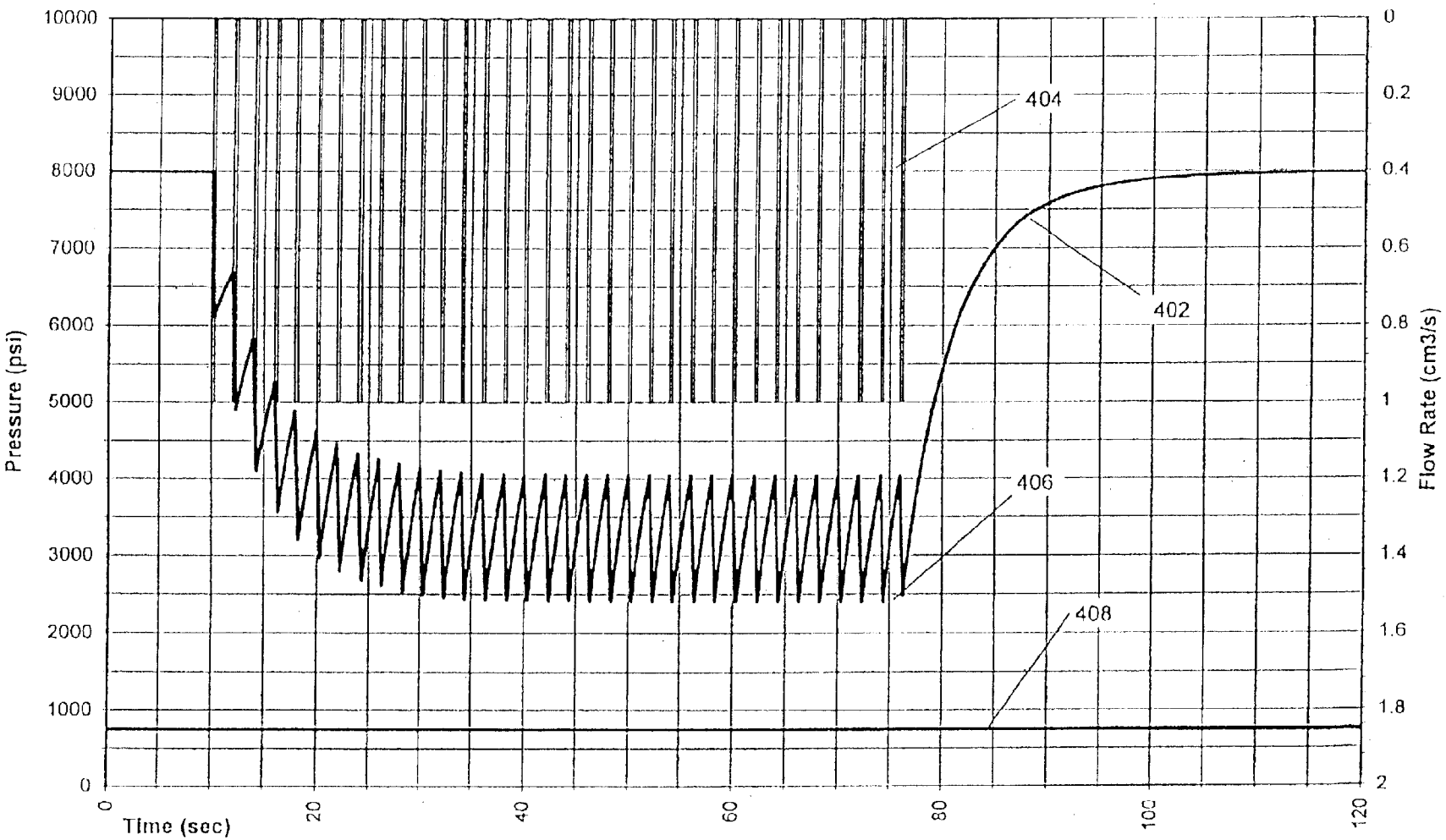
FIG. 4 is a graph illustrating the pressure within a formation tester during formation testing conducted in accordance with the same embodiment as FIG. 3, but with a different pulse width.
Figure 5:
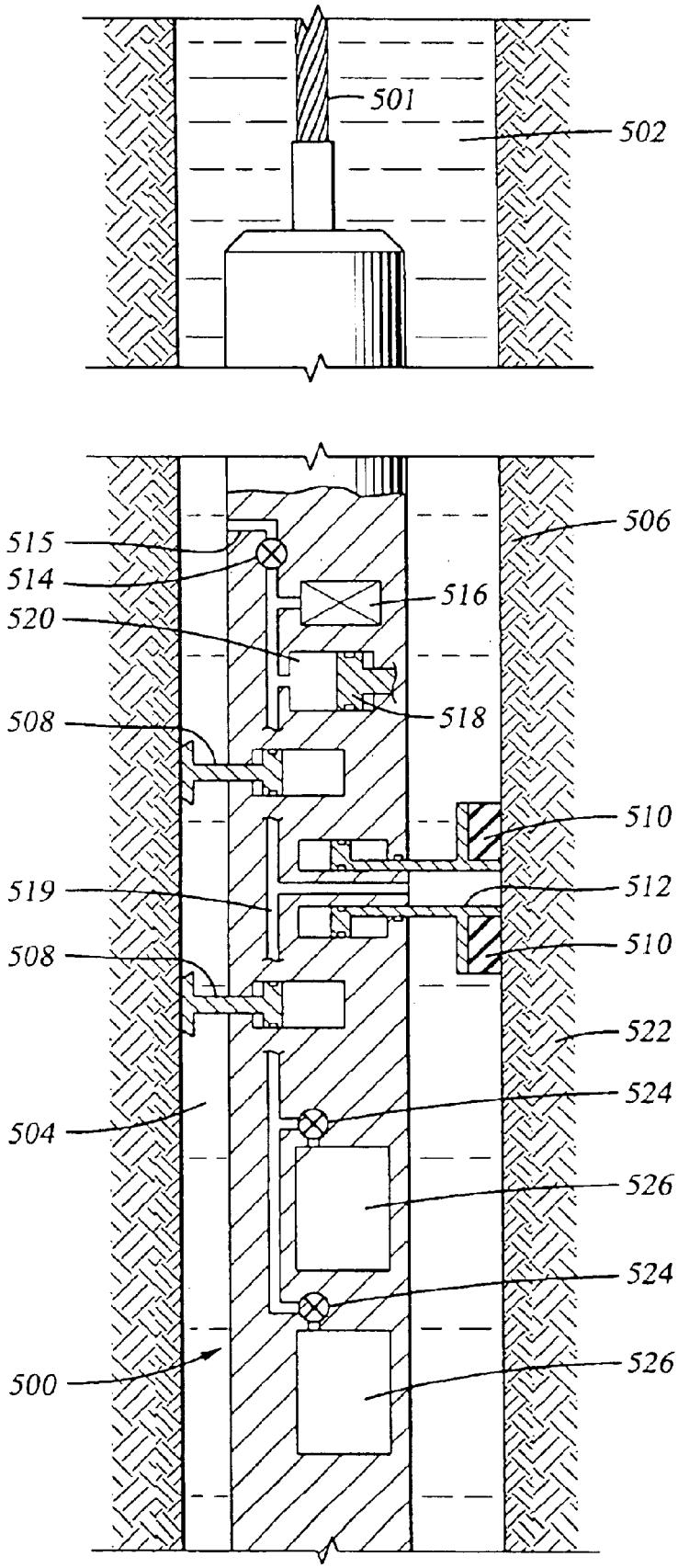
FIG. 5 is a diagram illustrating a known wireline formation tester.

Using a modulated drawdown of shorter pulses at a greater frequency allows an even closer approximation to a constant low drawdown rate. FIG. 4 depicts a pressure-versus-time curve 402 and a flow rate versus time curve 404 for pretest volume collected using an intermittent drawdown of 1.0 cc/sec pulsed for a 0.3 second duration every 2 seconds. In this embodiment, it takes 35 pulses, spread over 70 seconds, to collect a 10.5 cc pretest volume. Accordingly, the effective drawdown rate is again equal to the desired 0.15 cc/sec rate of FIG. 2. Like the drawdown depicted in FIG. 3, the intermittent drawdown of FIG. 4 causes the flowline pressure to dip down to low pressure threshold 406 but maintains a pressure above the bubble point of the fluid 408, which allows for an accurate determination of the formation pressure and permeability.

Comparing FIG. 3 to FIG. 4, the intermittent drawdown rate of FIG. 4 causes low-pressure threshold 406 of a lesser magnitude than the low-pressure threshold 306 of FIG. 3. The intermittent pulse rate of FIG. 4 shows that a shorter pulse and shorter idle time between pulses reduces the variation in the pressure pulse. Accordingly, the intermittent drawdown rate of FIG. 4 enables data collection from formation fluids with even higher bubble points because it results in a higher minimum pressure threshold during drawdown.

Comparing FIG. 2 to FIGS. 3 and 4, the modulated drawdown rates 304, 404 of FIGS. 3 and 4, respectively, when averaged, closely approximate the low 0.15 cc/sec drawdown rate 210 of FIG. 2. The use of a 0.15 cc/sec drawdown rate is merely illustrative and those of ordinary skill in the art would understand that the optimum drawdown rate depends both on the permeability of the formation and the bubble point of the formation fluid. It will also be understood that, by shortening the duration of the drawdown pulses and the time between the pulses, a closer approximation of the low drawdown rate can be achieved. Finding the optimum pulse rate to efficiently drawdown a representative sample depends on the permeability of the formation because the rate of fluid flow into the testing tool in relation to the drawdown rate will determine the pressure drop of the fluid within the flowline. Therefore, it is advantageous to adjust the intermittent drawdown rate depending on the permeability of the formation and the bubble point of the fluid so that a pretest can be performed in the shortest amount of time possible while maintaining the fluid above its bubble point and obtaining useful pressure versus time data for use in calculating the formation pressure and permeability. Because standard formation testing tools are designed to operate at a constant drawdown rate, the present invention extends the range of standard tools and enables the collection of data from a pretest involving a fluid drawn from low permeability formations using formation testing tools that would not otherwise have been capable of testing that formation.

In addition to the foregoing advantages, the present invention significant increases battery life, as the drain on the battery is greatly reduced. By cycling the motor, and/or otherwise actuating the system, each pretesting cycle can be accomplished with less energy.

While, as in the above examples, it is possible to estimate a predetermined pulse frequency and duration of drawdown, it is desirable to have a more flexible system. Therefore, it is preferable to have a control system that adjusts the frequency and duration of drawdown pulses by monitoring the pressure drop of the formation fluid and controlling the drawdown pulses based on that pressure. A control system that monitors both drawdown pressure and buildup pressure, which are then used to actuate the pretest piston, results in a controlled drawdown rate.

In the more flexible system, where pressure readings define the operation of the formation tester, once the tool is located in the desired formation zone, and positioned to perform a pretest, the pretest piston is actuated and draws at its set rate. The control system monitors either the pressure drop in the flowline using a pressure sensor or alternatively monitors the resistance of the pretest piston to movement. Once the pressure drop in the fluid chamber reaches a desired preset threshold level, preferably well above the bubble point of the formation fluid, the pretest piston is stopped. The control system then monitors the buildup pressure as formation fluid accumulates in the flowline. Once the buildup pressure reaches a desired level, the pretest piston is restarted. This process of stopping the pretest piston at a preset drawdown pressure and then restarting the piston after buildup pressure increases will continue until the desired drawdown volume has been drawn.

The method of the present invention allows the effective range of formation testing tools to be extended. This method can be used advantageously in LWD or MWD applications that rely on battery power because the maximum pressure drop during drawdown is reduced, therefore reducing the power requirements of the system. The present invention also finds application in wireline, as well as LWD and MWD applications, because it allows the collection of pressure versus time data, which is then used to calculate the pressure and permeability of formations with low permeabilities.

While the above represents the preferred embodiment of the present invention, it will be apparent to those skilled in the art that various changes and modifications may be made herein without departing from the scope of the invention as claimed.

What is claimed is:

1. A method for performing a pretest on a permeable rock formation containing a fluid having a bubble point comprising:

(a) disposing a formation pressure tester containing a chamber in a wellbore in the formation such that fluid communication is allowed between the tester and the formation but not between the tester and the wellbore;

(b) increasing the volume of the chamber so as to create a pressure differential between the tester and the formation;

(c) stopping step (b) when a measured value reaches a predetermined value;

(d) allowing fluid to flow into the chamber, thereby increasing the pressure within the chamber; and (e) repeating steps (b)–(d) until the volume of the chamber reaches a predetermined volume.

2. The method of claim 1 wherein the measured value is the pressure in the chamber.

3. The method of claim 1 wherein the measured value is time.

4. The method of claim 1 wherein the measured value is differential pressure between the formation and the tester.

5. The method of claim 1 wherein the pressure in the chamber is maintained above the bubble point of the fluid.

6. The method according to claim 1, further including the step of using a motor to power for step (b) and providing no power to the motor except during step (b).

7. The method of claim 1 wherein after the first increase in the volume of the chamber subsequent increases are triggered by an increase of pressure within the chamber to a predetermined value.

8. The method according to claim 1 wherein the rate of volume increase in step (b) is sufficiently greater than the permeability of the formation that the pressure in the chamber would drop below the bubble point of the fluid if the volume of the chamber were increased to the predetermined volume in a single step.

9. The method according to claim 8, further including the steps of recording pressure versus time data for the chamber and calculating the porosity of the formation from the pressure versus time data.

10. A method for performing a pretest on a permeable rock formation containing a fluid having a bubble point comprising:

(a) disposing a formation pressure tester containing a chamber in a wellbore in the formation such that fluid communication is allowed between the tester and the formation but not between the tester and the wellbore;

(b) increasing the volume of the chamber so as to create a pressure differential between the tester and the formation;

(c) stopping step (b) when a measured value reaches a predetermined value;

(d) allowing fluid to flow into the chamber, thereby increasing the pressure within the chamber; and (e) repeating steps (b)–(d) until the volume of the chamber reaches a predetermined volume;

wherein the rate of volume increase in step (b) is sufficiently greater than the rate of flow of fluid out of the formation that the pressure in the chamber would drop below the bubble point of the fluid if the volume of the chamber were increased to the predetermined volume in a single step; and wherein the pressure in the chamber is maintained above the bubble point of the fluid.

11. The method according to claim 10, further including the steps of recording pressure versus time data for the chamber and calculating the porosity of the formation from the pressure versus time data.

12. The method of claim 10 wherein the measured value is the pressure in the chamber.

13. The method of claim 10 wherein the measured value is time.

14. The method of claim 10 wherein the measured value is differential pressure between the formation and the tester.

15. An apparatus for performing a pretest on a permeable rock formation containing a fluid having a bubble point comprising:

a body;

a flowline disposed within said body, said flowline being in fluid communication with the formation;

a piston sealingly disposed in said body such that movement of said piston relative to said body changes the volume of said flowline, wherein the piston is actuated between an on mode in which it moves with respect to said body and an off mode in which it is stationary with respect to said body; and a control system that controls the movement said piston in response to a measured parameter and prevents the volume of the flowline from exceeding a predetermined maximum volume;

wherein the rate of change in the volume of said flowline when said piston is in the on mode is sufficiently greater than the rate of flow of fluid out of the formation that the pressure in the chamber would drop below the bubble point of the fluid if the volume of the chamber were increased to the predetermined maximum volume in a single step.

16. The method of claim 15 wherein the measured parameter is time.

17. The method of claim 15 wherein the measured parameter is differential pressure between the formation and the tester.

18. The method of claim 15 wherein after the first increase in the volume of the flowline subsequent increases are triggered by an increase of pressure within the flowline to a predetermined value.

19. The method of claim 15 wherein the measured parameter is the pressure in said flowline.

20. The method of claim 19 wherein the pressure in said flowline is maintained above the bubble point of the fluid.

21. The apparatus of claim 19 wherein the pressure in said flowline is measured by a pressure sensor.

22. The apparatus of claim 19 wherein the pressure in said flowline is determined from the load on said piston.

* * * * *